United States Patent [19]

Katsutani et al.

[11] Patent Number: 4,691,181

[45] Date of Patent: Sep. 1, 1987

[54] HINGE TYPE RELAY

[75] Inventors: Kazuji Katsutani, Yokohama; Shigeru Inaba, Zama, both of Japan

[73] Assignee: Niles Parts Co., Ltd., Tokyo, Japan

[21] Appl. No.: 855,431

[22] Filed: Apr. 24, 1986

[51] Int. Cl.[4] ..... H01H 67/02

[52] U.S. Cl. ..... 335/128; 335/270; 335/275

[58] Field of Search ..... 335/124, 128, 270, 275, 335/276, 279

[56] References Cited

U.S. PATENT DOCUMENTS 3,958,200 5/1976 Mally ..... 335/275
4,460,881 7/1984 Meister et al. ..... 335/128

FOREIGN PATENT DOCUMENTS 2614926 10/1977 Fed. Rep. of Germany ..... 335/128
170734 12/1980 Japan ..... 335/275
105749 7/1984 Japan ..... 335/128

*Primary Examiner*—George Harris
*Attorney, Agent, or Firm*—Vorys, Sater, Seymour and Pease

[57] ABSTRACT

This hinge type relay is provided with an elastically movable contact point at one side of an armature, while at another side is provided with a non-magnetic supporting piece formed bendingly downward, and further a fulcrum which supports the above non-magnetic supporting piece rockably at the lower portion of the upper bending portion of the yoke which supports the above armature is provided. By this, when the fixed contact point and the movable contact point of the hinge type relay contact with or separate from each other, the both contact point wipe and the generated magnetic flux of the electro magnet acts to the armature effectively.

22 Claims, 7 Drawing Figures

HINGE TYPE RELAY

BACKGROUND OF THE INVENTION

1. Field of the Invention

This invention relates to a hinge type relay wherein when a fixed contact point contacts with a movable point or separates from it, the both contact points are allowed to wipe.

2. Description of the Prior Art

In the conventional hinge relay, since the fluctiation fulcrum of the armature is at the upper portion of a yoke and both contact points do not wipe, an incomplete contact due to the abrasion of the contact points occurs. Referring to the embodiment, FIG. 1 is an example of the conventional hinge type relay, in which the armature 1 is insertedly supported to move rockably at the upper end 3*a* of the upper bending portion of the yoke 3 to which an electro magnet 2 is fixed, and said armature 1 rocks with the fulcrum at the inserting portion of the upper end 3*a* of the yoke 3 by erasing and exciting action of the electro magnet 2. In this case, a movable contact point 5 of a movable plate 4 fixed to the armature exerts only the contact and separating action to and from the fixed point 6, and both contact points 5 and 6 do not wipe.

SUMMARY OF THE INVENTION

This invention is to provide a hinge type relay werein when both fixed and movable contact points perform the contact or separating action, both contact points act to wipe and exert the generated magnetic flux of the electro magnet to the armature with high efficiency without increasing of the numbers of the constitution parts together with removing the above conventional defects. Also this invention is characterized in hinge type relay, wherein a downwardly bendingly formed supporting piece having a non-magnetic body is attached to one side of the armature of a hinge type relay having a movable contact point which acts elastically at another side thereof and a fulcrum portion which supports said supporting piece of the non-magnetic body rockably is provided at the lower portion of the upper bending portion of the yoke which supports said armature.

In a preferable embodiment of the hinge type of this invention, a cutaway portion is provided at the lower portion of the supporting piece of said non-magnetic body and the fulcrum portion of said yoke is provided as a projection at the lower side of the upper bending portion of the yoke so that the cutaway portion of the supporting piece of said non-magnetic body may be insertedly supported rockably.

Further, in another preferable embodiment of the hinge type relay, a cutaway portion provided at the lower end portion of the supporting piece of said non-magnetic body is a semi-circular shape.

Furthermore, the hinge relay of this invention is characterized in the fact that another side of the movable contact plate of non-magnetic body attached to the armature and possessing a movable contact point at one side is bendingly formed downward from the armature, and the fulcrum which supports another side of the movable contact plate of said non-magnetic body rockably is provided at the lower portion of the upper bending portion of the yoke which supports the above armature.

Still further, in a preferable embodiment of the hinge type relay, the fulcrum which supports the one side of the movable contact plate of said non-magnetic body rockably is a projection formed at the lower outer surface of said upper bending portion.

DESCRIPTION OF THE PREFERRED EMBODIMENTS

Figure 1:
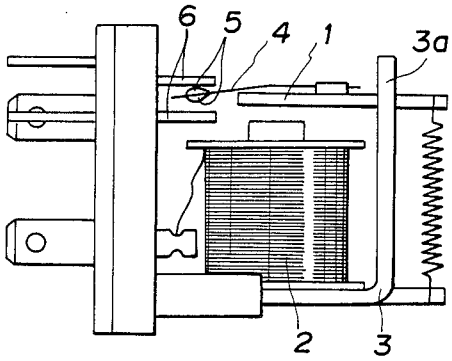
FIG. 1 (PRIOR ART)
FIG. 1 is an elevation view of the conventional hinge type relay.
Figure 2:
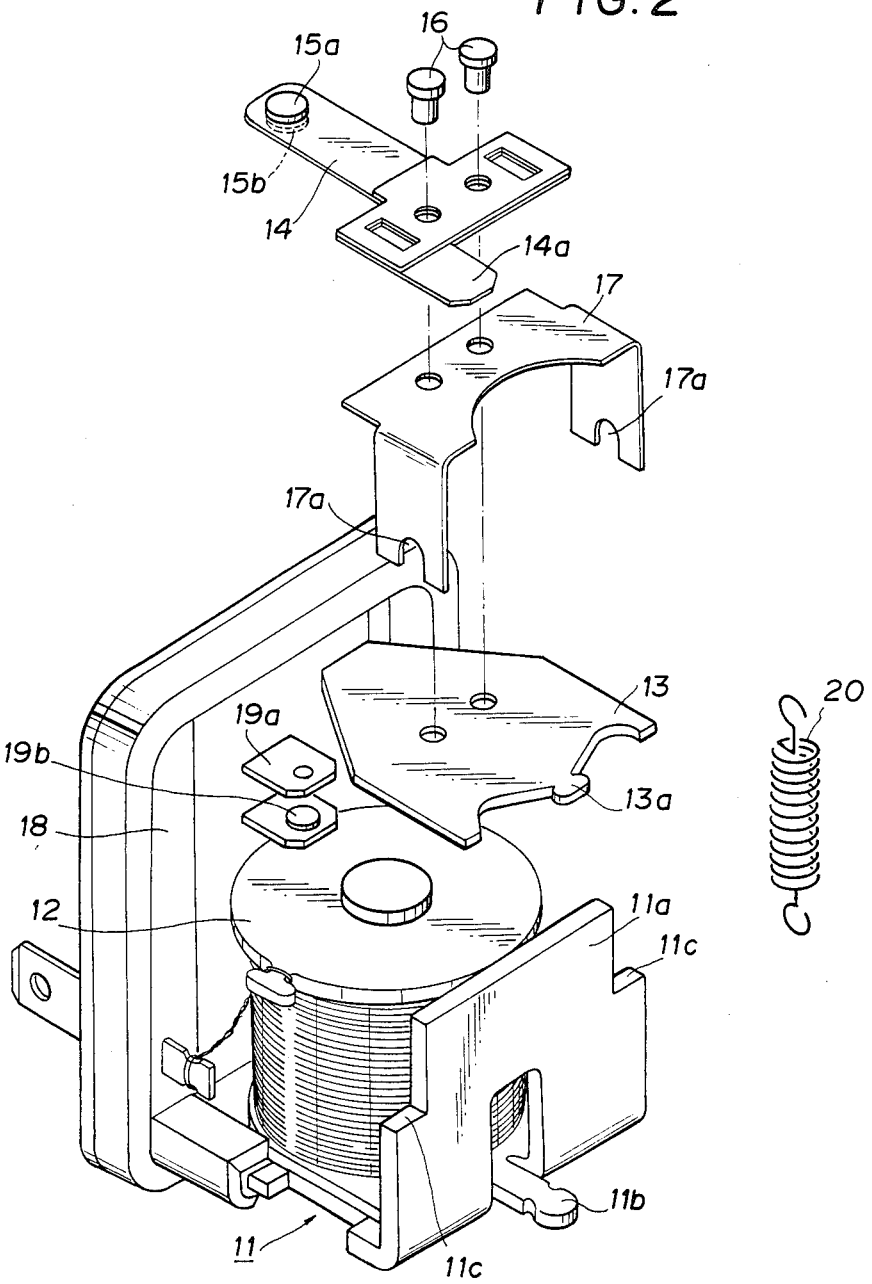
FIG. 2 is an exploded perspective view of a hinge type relay of a proper first embodiment of this invention.
Figure 3:
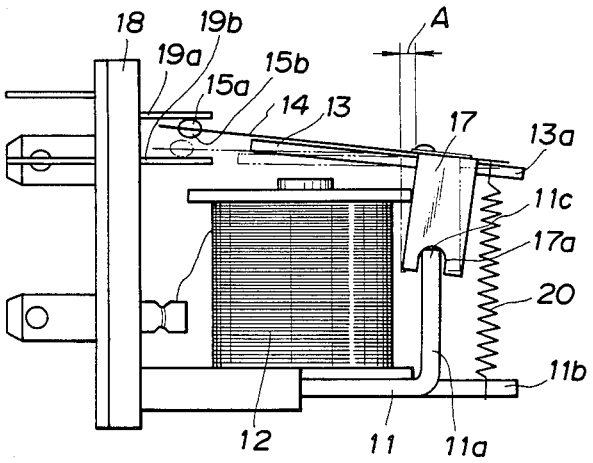
FIG. 3 is an elevation view of the hinge type relay of FIG. 2.
Figure 4:
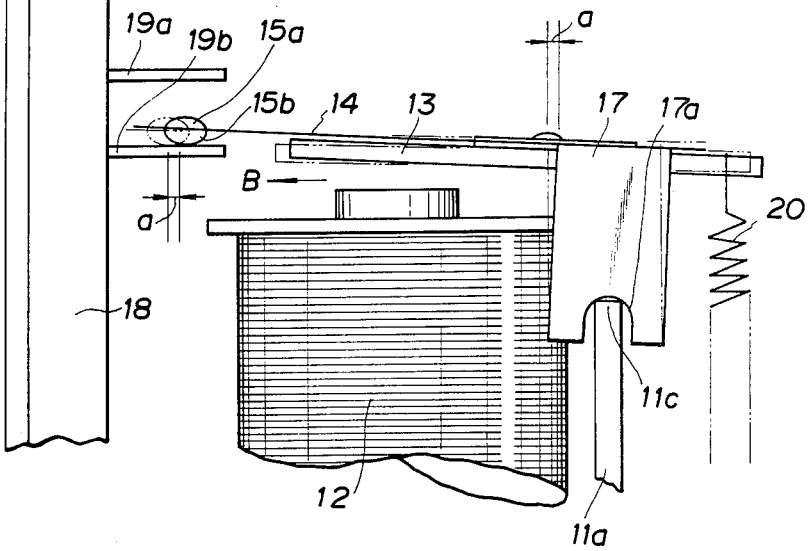
FIG.4 illustrates a material portion of the hinge type relay of FIG. 2.

Referring to FIG. 2, FIG. 3, and FIG. 4 a preferred embodiment of this invention will be described.

The numeral 11 is a yoke which fixes an electro magnet 12, and said yoke has an upper bending portion 11*a* bendingly formed upwardly and a projection 11*b* for latching a spring at the lower portion thereof. A projective portion 11*c* is formed at the lower side of said upper bending portion 11*a*.

The numberal 13 is a armature, and said armature has a projection 13*a* for latching a spring at another side.

The numeral 14 is an elastic movable contact plate having a fixed upper movable contact point 15*a* and a lower one 15*b* at the upper and the lower surfaces of one side thereof respectively, and said movable contact plate is fixedly tightened on the upper surface of the armature 13 with ribets 16.

The numeral 17 is a supporting piece of non-magnetic body grasped between said armature 13 and the movable contact plate 14, and the both sides of said supporting piece are bendingly formed downward and having a semi-circular cutaway portion 17*a* to be inserted into the upper surface of the projective portion 11*c* of the yoke 11 rockably at the lower end portion of said bending portion.

Accordingly, said armature 13 is provided with movable contact points 15*a*, 15*b* having elasticity at one side and with the supporting piece 17 of the non-magnetic body bendingly formed downward at another side, and said armature 13 is rockably supported at the lower portion of the upper bending portion 11*a* of the yoke 11 by rockably inserting the semi-circular cutaway portion 17*a* of said supporting piece 17 into the projective portion 11*c* of the yoke 11.

The numeral 18 is a relay base stand to fix said yoke 11 and electo magnet 12, wherein upper and lower fixed contact points 19*a*, 19*b* corresponding to the upper and lower movable contact points 15*a*, 15*b* of said movable contact plate 14 are arranged respectively.

The numeral 20 is a spring, one end of said spring is latched with the projection 11*b* for latching the spring of the yoke 11 and another end thereof is latched with the projection 13*a* for latching the spring of the armature 13, thereby being tensioned between both projection 11*b* and 13*a*.

Then, the operation of the hinge type relay of the above embodiment according to this invention will be described.

When the electro magnet 12 is not excited, the armature 13 is, as shown by real line in FIG. 3, inclined to the right in figure with the fulcrum at the semi-circular cutaway portion 17*a* of the lower end portion in the supporting piece 17 of the non-magnetic body by the elastic tension of the spring 20. The inclined state of said armature is latched by the fact that the upper movable contact point 15*a* is pressingly urged to the upper fixed contact point 19*a*. Further referring to the inclined state to the right of said armature 13, it is that the projection 13*a* for latching the spring is positioned at the lower portion and the movable contact points 15*a*, 5*b* of the movable contact plate 14 fixed at the upper surface thereof are positioned at the upper portion, while the lower movable contact point 15*b* is separated upward from the lower fixed contact point 19*b*.

At this time, the armature 13 is in a rocking state wherein it is projected outward the upper bending portion 11*a* of the yoke 11 by somewhat projecting distance A with the fulcrum at the semi-circular cutaway portion 17*a* of the supporting piece 17.

Now, when the electro magnet 12 is excited by current, the armature 13 receives the attraction force due to the excitation of the electro magnet 12, whereby said armature rocks to the left in figure with the fulcrum at the cutaway portion 17*a* of the lower end portion of the supporting piece 17 in the armature 13 against the elastic tension of the spring and is attracted to the iron core of the electro magnet 12.

Thus, when the armature 13 rocks to the left in figure as shown by the ghost line in FIG. 3, the upper movable contact point 15*a* of the movable contact plate 14 separates from the upper fixed contact point 19*a* and the lower movable contact point 15*b* of said movable contact plate 14 contacts with the lower fixed contact point 19*b*, whereby an electric circuit (not shown) connected with the both lower contact points 15*b*, 19*b* is switched to be closed. Further, the above projected distance A of the armature 13 gradually becomes narrow by the rocking of said armature 13, and when the rocking of the armature 13 becomes to be a horizontal state, said projected distance A disappears. Accordingly, the armature 13 moves by the length of said projected distance A in the left direction in the figure, that is moves transversely toward the inner direction of the upper bending portion 11*a* of the yoke 11.

The transverse movement together with the rocking of the above armature 13 is shown in FIG. 4 in details.

The armature 13 shown by the real line in figure represents the rocking state when the lower movable contact point 15*b* of the movable contact plate 14 contacts with the fixed contact point 19*b*. At this time, the armature 13 protrudes to the outward of the upper bending portion 11*a* of the yoke 11 by somewhat shorter projected distance a than the initial projected distance A. After that, when the rocking of the armature 13 advances and becomes to be a horizontal state, the armature 13 moves to the left as shown by the ghost line, that is, moves transversely in the direction of the fixed contact points 19*a*, 19*b*, whereby the projected distance a of the above armature 13 disappears.

Accordingly, the lower movable contact point 15*b* wipes in a direction shown by arrow B by the above projected distance a on the lower fixed contact point 19*b*.

Further, in order to assure a contact pressure of the contact point sufficiently, the constitution to incurvate the movable contact plate 14 elastically at the time of contact of both contact points is generally used. In this case, although the lower movable contact point 15*b* moves in a reversal direction against the above B direction shown by the above arrow due to the curved modification of the movable contact plate 14, the movement distance of the lower movable contact point 15*b* accompanied by the curved modification of said movable contact plate 14 is very small against the movement distance a to the B direction shown by arrow. Accordingly, it can be ignored.

Then, when the electro magnet 12 is erased, the armature 13 is returned automatically to the initial state with the fulcrum at the semi-circular cutaway portion 17*a* of the lower portion of the supporting piece 17 in said armature 13. The movable contact point 15*b* separates from the lower fixed contact point 19*b* to the upper portion, whereby the electric circuit connected with both lower contact points 15*b*, 19*b* is opened. Further, after the lower movable contact point 15*b* wipes in the reversal direction against B direction shown by the arrow by the movement distance a on the lower fixed contact point 19*b*, it is separated from the lower fixed point 19*b* and armature 13 protrudes to the outward of the upper bending portion of the yoke 11 by the projected distance A whereby said armature 13 returns to the initial inclined state.

Thus, the upper movable contact point 15*a* of the movable contact plate 14 is pressingly urged to the upper fixed contact point 19*a* again.

Further, when said upper movable contact point 15*a* is pressingly urged to the upper fixed contact point 19*a*, said upper movable contact point 15*a* wipes on the upper fixed contact point 19*a*.

In other words, the upper movable contact point 15*a* contacts with the upper fixed contact point 19*a* before a little rocking by which the projected distance to the outward of the yoke 11 of the armature 13 becomes to said projected distance A, and the upper movable contact point 15*a* wipes on the upper fixed contact point 19*a* by the rocking of the armature 13 which causes said projected distance A.

Further, when the armature 13 rocks due to the excitation of the electro magnet 12, the upper movable contact point 15*a* wipes on the upper fixed contact point 19*a* in the reversal direction against the wiping operation in case the upper movable contact point 15*a* is pressingly urged to the upper fixed contact point 19*a*.

Further, when the armature 13 rocks by the excitation and the erasing of the electro magnet 12, the generated magnetic flux of said electro magnet 12 attracts the armature 13 effectively and does not act to obstruct the rocking of the armature 13.

That is, since the supporting piece 17 to support the armature 13 on the upper bending portion 11*a* of the yoke 11 is a non-magnetic body, the generated magnetic flux of the electro magnet 12 does not act to said supporting piece 17 and only rocks the armature 13.

Then, other embodiment of this invention will be described referring to FIG. 5, FIG. 6 and FIG. 7 as follows.

The construction of this embodiment is nearly the same as the above embodiment other than the movable contact plate, the supporting plate, the armature and the part of the construction at the upper bending portion of the yoke.

Figure 5:
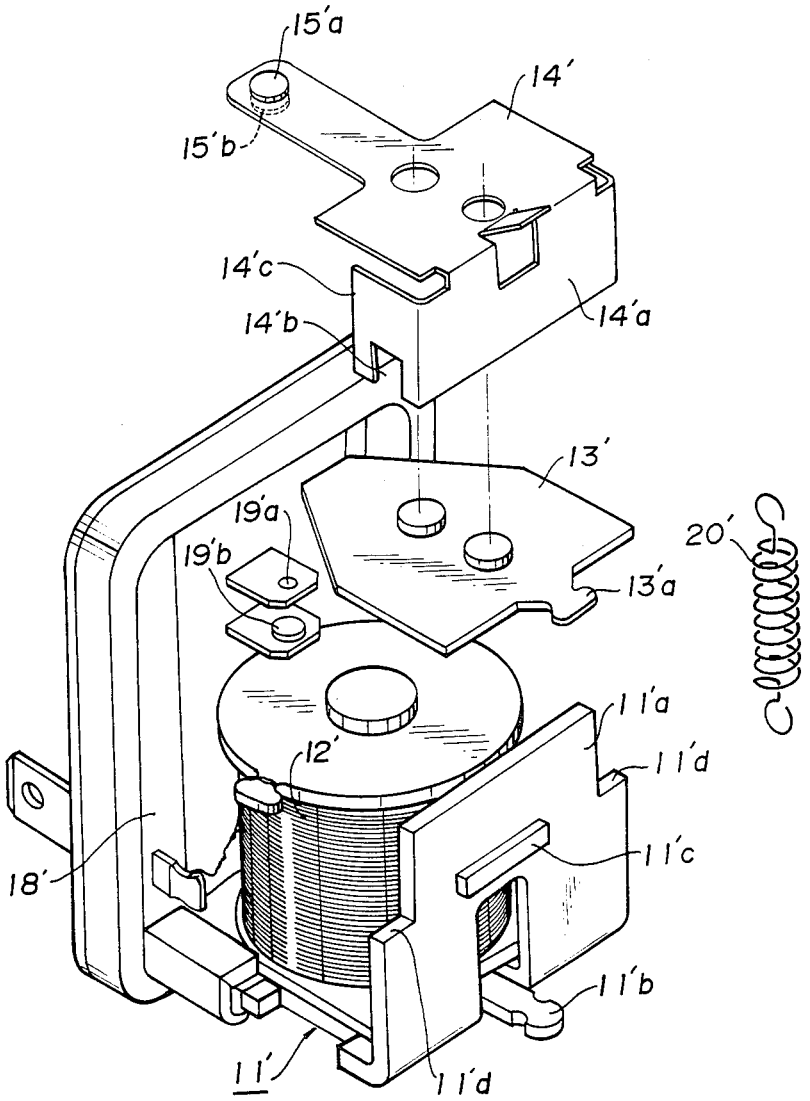
FIG. 5 is an exploded perspective view of a hinge type relay which shows a modified embodiment of this invention.
Figure 6:
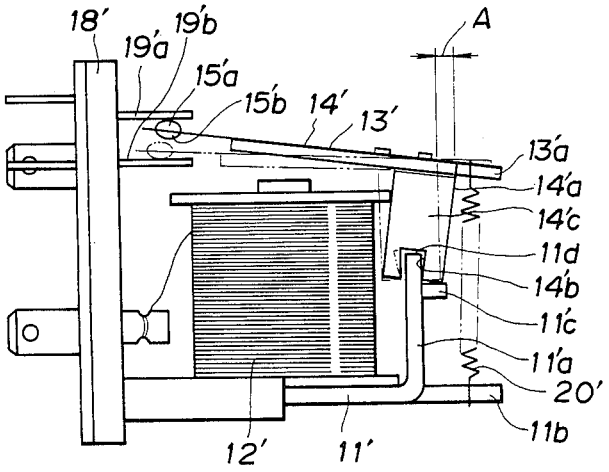
FIG. 6 is an elevation view of the hinge type relay of FIG. 5.
Figure 7:
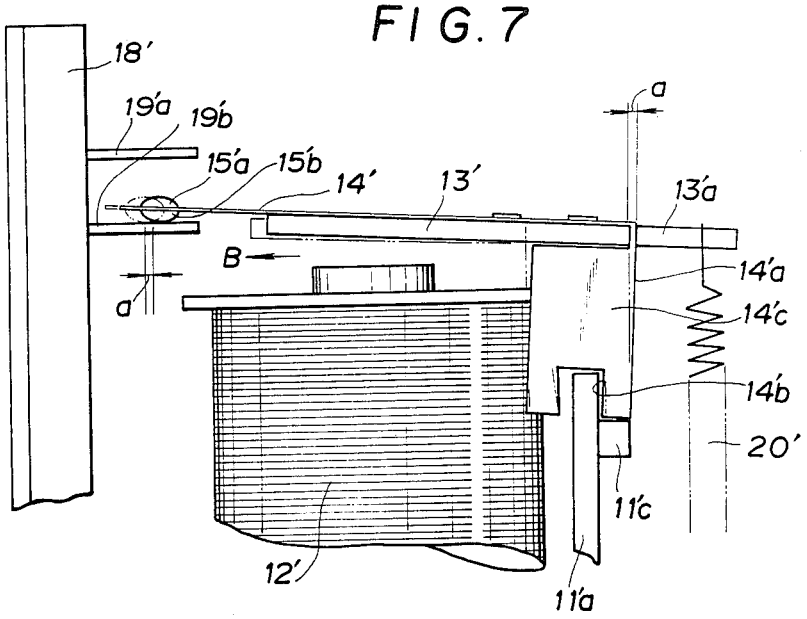
FIG. 7 illustrates a material portion of the hinge type relay of FIG. 5.

In FIGS. 5, 6 and 7, the numeral 11' is a yoke to which fixed an electro magnet 12', said yoke having an upper bending portion 11'a formed bendingly to the upward and having a projection 11'b for latching a spring to the downward. At the lower outer surface of said upper bending portion 11'a, together with forming a projection 11'c, a projected portion 11'd is formed at the lower side of the upper bending portion 11'a.

The numeral 13' is an armature, and at another portion of this armature a projection 13'a for latching a spring is provided.

The numeral 14' is an elastic non-magnetic movable contact plate wherein an upper and a lower movable contact points 15'a and 15'b are fixedly secured at the upper and the lower surfaces of one side respectively, said movable contact plate being fixedly secured to the upper surface of said armature 13'.

At another side of the movable contact plate 14' of said non-magnetic body, a supporting piece 14'a bended downwardly is formed. Further, at the left and right sides of said supporting pieces 14'a, a stopper piece 14'c having a inserting groove 14'b at the lower portion is bendingly formed.

The movable contact plate 14' secured to the said armature 13' is provided with movable contact points 15'a, 15'b at one side and posses a supporting piece 14'a bendingly formed to the lower direction of the armature 13' at the other side. The armature 13' is supported fluctuatably at the lower portion of the upper bending portion 11'a of the yoke 11' by placing the lower end portion of said supporting piece 14'a at the upper surface of the projection 11'c of the yoke 11'.

Accordingly, the projection 11'c of the yoke 11' forms a fulcrum which supports the armature fluctuatably.

Further, the inserting groove 14'b of the stopper piece 14'c of the movable contact plate 14' is latchingly inserted into the projected portion 11'd of the yoke 11 so as to make the movable contact plate 14' fluctuatable.

The numeral 18 is a relay base stand for fixing said yoke 11' and the electro magnet 12', and the upper and lower fixed contact points 19'a, 19'b corresponding to the upper and lower movable contact points 15'a, 15'b are arranged thereon.

The numeral 20' is a spring, one end of said spring is latched with a projection 11'b for latching the spring of yoke 11' and the other end thereof is latched with a projection 13'a for latching the spring of the armature 13', thereby being tensioned between both projections 11'b and 13'a.

Then, the operation of the hinge type relay of the above embodiment according to this invention will be described as follows.

When the electro magnet 12' is not excited, the armature 13' is, as shown by a real line in FIG. 6, inclined to the right in figure with the fulcrum at the lower end portion of the supporting piece 14'a of the movable contact plate 14' of the non-magnetic body with the aid of the elastic tension of the spring. The inclined state of said armature is latched by the fact that the upper movable contact point 15'a is pressingly urged to the upper fixed contact point 19'a. Further, referring to the inclined state of the armature to the right, it is in a state that the projection 13'a for latching the spring is positioned at the lower portion, and the movable contact points 15'a, 15'b of the movable contact plate 14' fixedly attached to the upper surface thereof is positioned at the upper portion, while the lower movable contact point 15'b is separated from the lower fixed contact point 19'b upperward.

Further, at this time the armature 13' is in the projected rocking state by somewhat projected distance A to the outward of the upper bending portion 11'a of the yoke 11' with the fulcrum at the lower end of the supporting piece 14'a of the movable contact plate 14'.

When the electro magnet 12' is excited by current, the armature 13 receives the exciting attractive force of the electro magnet 12' and rocks to the left in figure with the fulcrum at the lower end portion of the supporting piece 14'a of the movable contact plate 14' against the elastic tension of the spring 20', thereby being adsorbed to the core of the electro magnet 12.

Thus, when the armature 13' rocks, as shown by the ghost line in FIG. 6, to the left in figure, the upper movable contact point 15'a, of the movable contact plate 14' is separated from the upper fixed contact point 19'a and the lower movable contact point 15'b contacts with the lower fixed point 19'b, whereby the electric circuit (not shown) connected with both lower contact points 15'b, 19'b is closed. Further, the projected distance A of the armature 13' is gradually narrowed by the rocking of said armature 13' and when the armature 13' rocks to the horizontal state, said projected distance A disappears. Accordingly, the armature 13' moves to the left in figure by distance A or the armature 13' moves transversely inner direction of the upper bending portion 11'a of the yoke 11'.

The transverse movement according to the rocking of said armature 13' will be described in FIG. 7 in details.

The armature 13' shown by real line in Figure represents a rocking state where the lower movable contact point 15'b of the movable contact plate 14' contacts with the fixed contact point 19'b. At this time the armature 13' is protruded to the outward of the upper bending portion 11'a of the yoke 11' by somewhat shorter projective distance a than the initial projective distance A. After that, when the rocking of the armature 13' advances to become horizontal state, the armature 13' moves, as shown by the ghost line in figure, to the left, or the armature 13' moves transversely to the direction of the fixed contact points 19'a, 19'b, whereby the projected distance a of the armature 13' disappears.

Accordingly, the lower movable contact point 15'b wipes in B direction shown by arrow by said projected distance a on the lower fixed contact point 19'b.

Further, in order to assure the contact pressure of the contact point sufficiently, it is general to compose the movable contact plate 14' at the time of contact of the contact points so that it may be elastically a curved modification. By this curved modification of the movable contact plate 14', the lower movable contact point 15'b moves in a reversal direction against said arrow direction B. However, the movement distance of the lower movable contact point 15'b according to the curved modification of said movable contact plate 14' is very small. Accordingly, it is no necessary to consider this movement distance a with respect to that of the arrow direction B and it is ignorable.

Then, when the electro magnet 12' is erased, the armature 13' rocks to return to the initial state automatically by the elastic stability of the spring 20' with the fulcrum at the lower end portion of the supporting piece 14'a of the movable contact plate 14', and the lower movable contact point 15'b is separated from the lower fixed contact point 19'b to the upward, whereby the electric circuit connected with both lower contact points 15'b, 19'b is opened. Further, after the lower movable contact point 15'b wipes in a reversal direction against the arrow direction B on the lower fixed contact point 19'b by the movement distance a, it is separated from the lower fixed contact point 19'b and the armature 13' is protruded to the outward of the upper bending portion ll'*a* of the yoke 11' by the projected distance A.

Then, the upper movable contact point 15'a of the movable contact plate 14' is pressingly urged to the upper fixed contact point 19'a again.

Further, when said upper movable contact point 15'a is pressingly urged to the upper fixed contact point 19'a, said upper movable contact point 15'a wipes on the upper fixed contact point 19'a.

In other words, the upper movable contact point 15'a contacts with the upper fixed contact point 19'a before a little rocking by which the projected distance to the outward of the yoke 11' of the armature 13' becomes to be said projected distance A, and the upper movable contact point 15'a wipes on the upper fixed contact point 19'a by the rocking wherein the projected distance of the armature 13' becomes A.

Further, when the armature 13' rocks due to the exciting operation of the electro magnet 12', the upper movable contact point 15'a wipes on the upper fixed contact point 19'a in the reversal direction against the direction of the wiping operation of the time when said upper movable contact point 15'a is pressingly urged to the fixed contact point 19'a and is separated from it.

Furthermore, when the armature 13' rocks by the exciting and erasing operation of the electro magnet 12', the generated magnetic flux of the electro magnet 12' attracts the armature 13' effectively, and does not act to obstruct the rocking of the armature 13'.

In other words, since the supporting piece 14'a of the movable contact plate 14' which supports the armature 13' to the yoke 11' is a non-magnetic body, the generated magnetic flux of the electro magnet 12' does not exert any action on the supporting piece 14'a and rocks the armature 13'.

Still further, the stopper piece 14'c formed in the movable contact plate 14' acts to prevent the occurence of a discrepancy in the supporting state of the armature 13' in the lower portion of the yoke 11'.

In other words, since the inserting groove 14'b of the stopper piece 14'c is inserted to latch into the projected portion 11'd of the yoke 11' rockably, when the armature 13' rocks by exciting and rasing operation of the electro magnet 12', the lower end of the supporting piece 14'a of the movable contact plate 14' is prevented the discrepancy from the placing position on the upper surface of the projection 11'c of the yoke 11'.

Further, in the movable contact plate 14' of other embodiment of this invention, a supporting piece 14'a and a stopper piece 14'c are bendingly formed at another side, but not restrained by this. The main point is that in order to support the movable contact plate 14' and the armature 13' to the lower portion of the upper bending portion of the yoke rockably, the bending formed portion is provided at another side.

The hinge type relay of this invention is thus composed and operated and the following effect can be obtained.

In other words, when the movable contact point contacts with the fixed contact point or separates from it, it wipes on the fixed contact point at the same time. Accordingly, various kinds of foreign matters such as oxides, sulfides, carbides, dusts and the like which generate at the relay contact point for a long period can be removed, thereby being able to keep the electric resistance at the relay contact point low. Therefore, it is possible to provide the relay excellent in endurance.

Further, since the supporting piece which supports the armature to the yoke is a non-magnetic body, the magnetic force of the electro magnet rocks the armature efficiently and does not exert any operation which obstacles the fluctuation of the armature through said supporting piece. Accordingly, there is no fear of keeping the magnet between armature and yoke and is possible to provide a hinge type relay having a sufficient rocking mechanism of the armature with a comparatively small magnet.

Further, this hinge type relay has such effect as being able to be prepared at low cost with comparatively simple constitution wherein a non-magnetic movable contact plate is only bendingly formed without any increase of the number of constituted parts.

What is claimed is:

1. A hinge type relay comprising:

an armature, a contact plate connected to said armature, a contact point connected at an outer end of said contact plate and generally downwardly disposed, a support member connected to said contact plate, said support member having a groove, a yoke supporting said armature and having a fulcrum portion, said support member being positioned with said groove resting against said fulcrum portion so that said support member can rock on said fulcrum portion, a generally upwardly disposed fixed contact point, an electromagnetic means positioned to magnetically attract said armature, and thereby move said contact point so that it contacts said fixed contact point, a biasing means for biasing said armature away from said electromagnetic means, and said support member rocking on said fulcrum portion when said electromagnetic means attracts said armature towards it and causing said contact point, after initially contacting said fixed contact point, to slide on said fixed contact point.

2. The relay of claim 1 including, said groove defining a first groove, said fulcrum portion defining a first fulcrum portion, said support member including a first arm and a second arm spaced from said first arm, said first groove being formed on said first arm, said second arm having a second groove, and a second fulcrum portion on which said second groove is positioned.

3. The relay of claim 2 including, said support member being fixed on top of said armature, and said contact plate being secured on top of said support member.

4. The relay of claim 3 including, a rivet means passing through said contact plate, support member, and armature for securing them together in sandwiched relation.

5. The relay of claim 1 including,
said support member being disposed at a right angle relative to said contact plate.
6. The relay of claim 1 including,
said contact plate and said support member being formed from a single piece of material bent to form said contact plate and said support member in relative angled relation.
7. The relay of claim 6 including,
said armature having an arm to which said biasing means is connected, and
said single piece of material having an opening therethrough through which said arm passes.
8. The relay of claim 1 including,
said support member including a support portion connected to and formed at a right angle downwardly from said contact plate, and a stopper portion formed at right angle inwardly to said support portion, and
said groove being formed on a lower surface of said stopper portion.
9. The relay of claim 1 including,
said armature being positioned above said electromagnetic means,
said support member and said groove being downwardly depending relative to said contact plate, and
said support member resting on top of said fulcrum portion.
10. The relay of claim 1 including,
said groove being configured as a rectangle.
11. The relay of claim 1 including,
said groove being configured as a semi-circle.
12. The relay of claim 1 including,
said support member being formed of a nonmagnetic material.
13. The relay of claim 1 including,
said contact point sliding on the surface of said fixed contact point after initially contacting said fixed contact point as said armature is attracted further towards said electromagnetic means thereby causing said support member to rock on said fulcrum portion towards said fixed contact point.
14. The relay of claim 1 including,
said electromagnetic means being attached to said yoke.
15. The relay of claim 1 including,
said fixed contact point defining a first fixed contact point, and
a second fixed contact point fixed in spaced relation to said first fixed contact point and positioned for contact by said contact point.
16. The relay of claim 15 including,
said contact point sliding on the surface of said second fixed contact point after initially contacting said second fixed contact point as said armature is biased further away from said electromagnetic means by said biasing means thereby causing said support member to rock on said fulcrum portion away from said second fixed contact.
17. The relay of claim 15 including,
a relay base,
said first fixed contact point being attached to said relay base, and
said second fixed contact point being attached to said relay base so as to be positioned above said first fixed contact point.
18. The relay of claim 1 including,
said contact point sliding on said fixed contact point in a direction away from said electromagnetic means.
19. A hinge type relay comprising:
an armature,
a contact plate connected to said armature and having an outer plate end,
a lower contact point at the lower surface of said outer plate end,
yoke having a yoke portion presenting an upwardly-disposed surface,
a supporting member having a channel forming a downwardly-disposed surface resting on said upwardly-disposed surface,
said supporting member supporting said contact plate,
an electromagnetic means positioned generally beneath said armature for magnetically attracting said armature towards it,
a first fixed contact point positioned so that said lower contact point contacts it in a generally downward direction when said electromagnetic means is energized,
a biasing means for biasing said lower contact point away from said first fixed contact point, and
said supporting member rocking on said upwardly-disposed surface when said electromagnetic means attracts said armature towards it and causing said lower contact point, after initially contacting said first fixed contact point, to slide on said first fixed contact point.
20. The relay of claim 19 including,
said supporting member being connected to said contact plate along the edge of said contact plate opposite to said outer plate end and depending downwardly therefrom and extending forwardly towards said outer plate end to define a lateral support portion, and
said channel being formed in said lateral support position.
21. The relay of claim 20 including,
said armature having an armature arm to which said biasing means is attached,
said supporting member having an opening along said edge of said contact plate, and
said armature arm passing through said opening.
22. The relay of claim 20 including,
said yoke portion comprising a laterally extending yoke shoulder.

* * * * *